US011925840B2

(12) United States Patent
Shimahara

(10) Patent No.: US 11,925,840 B2
(45) Date of Patent: Mar. 12, 2024

(54) GOLF CLUB HEAD

(71) Applicant: Sumitomo Rubber Industries, Ltd., Hyogo (JP)

(72) Inventor: Yuki Shimahara, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 17/849,377

(22) Filed: Jun. 24, 2022

(65) Prior Publication Data

US 2023/0017457 A1 Jan. 19, 2023

(30) Foreign Application Priority Data

Jul. 12, 2021 (JP) ..... 2021-115206

(51) Int. Cl.
*A63B 53/04* (2015.01)

(52) U.S. Cl.
CPC ..... *A63B 53/047* (2013.01); *A63B 53/0408* (2020.08)

(58) Field of Classification Search
CPC ..... A63B 53/047; A63B 53/0475
USPC ..... 473/324–350
See application file for complete search history.

(56) References Cited

U.S. PATENT DOCUMENTS 4,540,178 A * 9/1985 Johnson ..... A63B 60/00 228/101
4,852,880 A * 8/1989 Kobayashi ..... A63B 60/00 473/349
4,883,274 A * 11/1989 Hsien ..... A63B 60/00 473/335
4,883,275 A * 11/1989 Boone ..... A63B 60/52 473/335
5,509,660 A * 4/1996 Elmer ..... A63B 53/0466 473/330
5,522,593 A * 6/1996 Kobayashi ..... A63B 60/00 473/340
5,584,770 A * 12/1996 Jensen ..... A63B 53/0466 473/345
5,669,826 A * 9/1997 Chang ..... A63B 53/04 473/332
5,833,551 A * 11/1998 Vincent ..... A63B 60/00 473/349
6,080,068 A * 6/2000 Takeda ..... A63B 53/04 473/307
6,206,790 B1 * 3/2001 Kubica ..... A63B 53/04 473/335

(Continued)

FOREIGN PATENT DOCUMENTS

GB 2281040 A * 2/1995 ..... A63B 53/04
JP 2001204863 A * 7/2001 ..... A63B 53/047

(Continued)

*Primary Examiner* — Alvin A Hunter
(74) *Attorney, Agent, or Firm* — Studebaker & Brackett PC

(57) ABSTRACT

A golf club head includes a face portion including a striking face for hitting a ball, a back face opposite the striking face, and a head outer peripheral surface extending between the striking face and the back face. The back face includes a cavity recessed on a striking face side and a frame portion extending along the head outer peripheral surface so as to surround the cavity. The frame portion is provided with at least one recess that extends along the striking face and opens to the head outer peripheral surface.

15 Claims, 13 Drawing Sheets

(56) References Cited

U.S. PATENT DOCUMENTS 6,440,010 B1 * 8/2002 Deshmukh ..... A63B 53/04 473/335
6,551,200 B1 * 4/2003 Golden ..... A63B 53/047 473/349
7,207,900 B2 * 4/2007 Nicolette ..... A63B 60/02 473/349
7,530,902 B2 * 5/2009 Nakamura ..... A63B 60/02 473/335
7,604,550 B1 * 10/2009 Currie ..... A63B 53/047 473/342
8,133,129 B2 * 3/2012 Boyd ..... A63B 53/047 473/335
8,449,406 B1 * 5/2013 Frame ..... A63B 53/047 473/332
8,821,313 B1 * 9/2014 Dawson ..... A63B 53/047 473/335
8,840,485 B2 * 9/2014 Jorgensen ..... A63B 53/047 473/328
8,858,364 B2 * 10/2014 Deng ..... A63B 60/00 473/350
9,764,208 B1 * 9/2017 Parsons ..... A63B 53/0475
9,821,202 B2 * 11/2017 Hettinger ..... A63B 53/047
10,286,268 B2 * 5/2019 Parsons ..... A63B 53/0475
10,744,377 B1 * 8/2020 Chuang ..... A63B 53/0433
11,065,513 B2 * 7/2021 Tassistro ..... A63B 53/06
11,318,525 B1 * 5/2022 Su ..... B21K 17/00
2002/0165041 A1 * 11/2002 Takeda ..... A63B 60/02 473/349
2003/0032499 A1 * 2/2003 Wahl ..... A63B 53/047 473/334
2004/0043830 A1 * 3/2004 Imamoto ..... A63B 53/047 473/332
2004/0092331 A1 * 5/2004 Best ..... A63B 53/047 473/332
2004/0266548 A1 * 12/2004 Cheng ..... A63B 53/047 473/350
2005/0026716 A1 * 2/2005 Wahl ..... A63B 60/02 473/345
2005/0143190 A1 * 6/2005 Takeda ..... A63B 53/047 473/349
2005/0164802 A1 * 7/2005 Wood ..... A63B 53/0475 473/287
2005/0197208 A1 * 9/2005 Imamoto ..... A63B 53/047 473/349
2005/0239570 A1 * 10/2005 Best ..... A63B 53/047 473/292
2008/0020861 A1 * 1/2008 Adams ..... A63B 60/00 473/336
2008/0318706 A1 * 12/2008 Larson ..... A63B 53/04 473/291
2009/0137339 A1 * 5/2009 Nakano ..... A63B 60/54 473/332
2009/0305815 A1 * 12/2009 Hirano ..... A63B 53/047 473/350
2011/0021283 A1 * 1/2011 Hatton ..... A63B 60/00 473/409
2011/0021285 A1 * 1/2011 Shimazaki ..... A63B 60/02 473/332
2011/0201443 A1 * 8/2011 Best ..... A63B 53/047 473/291
2013/0029775 A1 * 1/2013 Demkowski ..... A63B 53/047 473/291
2013/0331201 A1 * 12/2013 Wahl ..... A63B 53/047 473/329
2014/0335973 A1 * 11/2014 Takechi ..... A63B 53/047 473/349
2015/0133232 A1 * 5/2015 Taylor ..... A63B 53/0475 473/329
2015/0328505 A1 * 11/2015 Nicolette ..... A63B 53/047 473/331
2015/0328508 A1 * 11/2015 Parsons ..... B29C 45/20 473/350
2016/0101330 A1 * 4/2016 Harrington ..... A63B 53/047 473/338
2016/0193508 A1 * 7/2016 Issertell ..... A63B 60/00 473/349
2016/0339309 A1 * 11/2016 Taylor ..... A63B 53/047
2016/0375320 A1 * 12/2016 Franz ..... A63B 53/0475 473/291
2017/0361177 A1 * 12/2017 Hebreo ..... A63B 53/047
2018/0104552 A1 * 4/2018 Hebreo ..... A63B 60/52
2018/0185717 A1 * 7/2018 Demkowski ..... A63B 53/047
2018/0236324 A1 * 8/2018 Hebreo ..... A63B 53/0466
2018/0256947 A1 * 9/2018 Mata ..... A63B 53/0475
2019/0134473 A1 * 5/2019 Golden ..... A63B 53/0408
2019/0282870 A1 * 9/2019 Hebreo ..... A63B 53/0462
2021/0086044 A1 * 3/2021 Parsons ..... A63B 60/02
2021/0113897 A1 * 4/2021 Halberg ..... A63B 53/0408
2021/0178235 A1 * 6/2021 Halberg ..... A63B 60/52
2021/0331045 A1 * 10/2021 Halberg ..... A63B 60/02
2022/0096902 A1 * 3/2022 Parsons ..... A63B 53/04
2023/0017457 A1 * 1/2023 Shimahara ..... A63B 60/52

FOREIGN PATENT DOCUMENTS

JP 2002143355 A * 5/2002 ..... A63B 53/047
JP 2002143356 A * 5/2002 ..... A63B 53/047
JP 2002253712 A * 9/2002 ..... A63B 53/047
JP 2012065803 A * 4/2012 ..... A63B 53/047
JP 2012105821 A * 6/2012 ..... A63B 53/047
JP 5689214 B2 * 3/2015 ..... A63B 53/04
JP 2019017523 A * 2/2019 ..... A63B 53/042
JP 2020-178933 A 11/2020
KR 20050088927 A * 9/2005
WO WO-2016115575 A2 * 7/2016 ..... A63B 53/0408

* cited by examiner

GOLF CLUB HEAD

RELATED APPLICATIONS

This application claims the benefit of foreign priority to Japanese Patent Application No. JP2021-115206, filed Jul. 12, 2021, which is incorporated by reference in its entirety.

FIELD OF THE INVENTION

The present disclosure relates to a golf club head.

BACKGROUND OF THE INVENTION

The patent document 1 below discloses a cavity-back golf club in which a cavity is formed on the back face side.

PATENT DOCUMENT

[PATENT DOCUMENT 1] Japanese Unexamined Patent Application Publication 2020-178933

SUMMARY OF THE INVENTION

Cavity back golf club heads have the advantage that the moment of inertia of the head is large and the direction of struck balls are stable because a large amount of weight is distributed to the peripheral region of the face portion.

On the other hand, cavity-back golf club heads have a frame portion with a thick wall so as to surround the cavity, the face is less likely to bend when a ball is struck, and thus there is room for further improvement in the rebound performance.

The present disclosure has been made in view of the above problem and has a major object to provide a golf club head capable of improving rebound performance without losing the advantages of the cavity back.

In one aspect of the present disclosure, a golf club head includes a face portion including a striking face for hitting a ball, a back face opposite the striking face, and a head outer peripheral surface extending between the striking face and the back face, wherein the back face including a cavity recessed on a striking face side and a frame portion extending along the head outer peripheral surface so as to surround the cavity, and the frame portion is provided with at least one recess that extends along the striking face and opens to the head outer peripheral surface.

DETAILED DESCRIPTRION OF THE INVENTION

Figure 1:
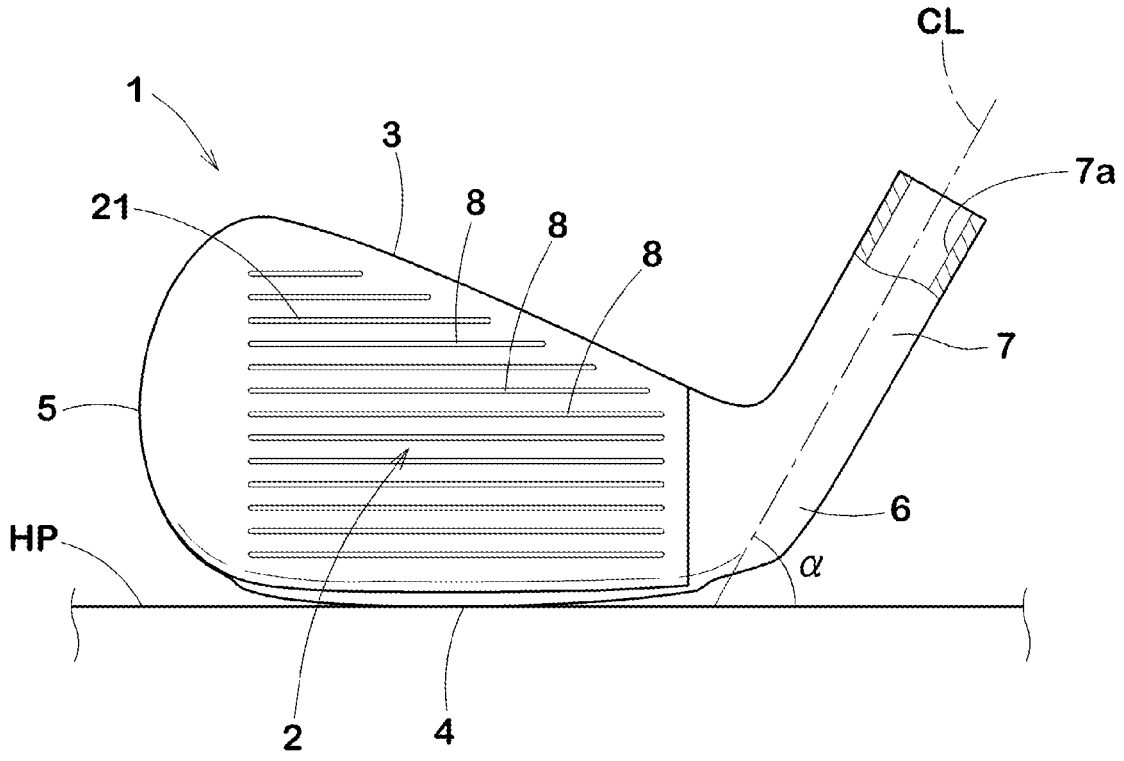
FIG. 1 is a front view of a golf club head according to the first embodiment.

Hereinafter, one or more embodiments of the present disclosure will be described with reference to the drawings.

The embodiments herein are not intended to limit this disclosure in any way. In addition, each embodiment can be used alone or in various combinations. Note that throughout the specification, the same or common elements are given the same reference numerals, and duplicate explanations are omitted.

The First Embodiment

FIGS. 1 to 4 respectively illustrate a front view, a side view from the toe side, a rear view, and a perspective view of a golf club head (hereinafter, simply referred to as "head") 1 in accordance with the first embodiment.

As illustrated in FIGS. 1 to 4, the head 1, for example, includes a face portion 2, a top 3, a sole 4, a toe 5, a heel 6 and a hosel 7. The head 1 in the present embodiment, for example, is embodied as an iron-type golf club head formed of a metallic material.

The face portion 2 includes a striking face 21 which is the surface for striking a ball. A plurality of face lines 8 is formed on the striking face 21 to increase the friction with the ball. The face lines 8 according to the present embodiment, for example, are narrow grooves extending straight in the toe-heel direction. The face lines 8 are formed in a main striking area intended for the head 1. Note that in some drawings, the face lines 8 are omitted.

[Reference State]

Figure 5:
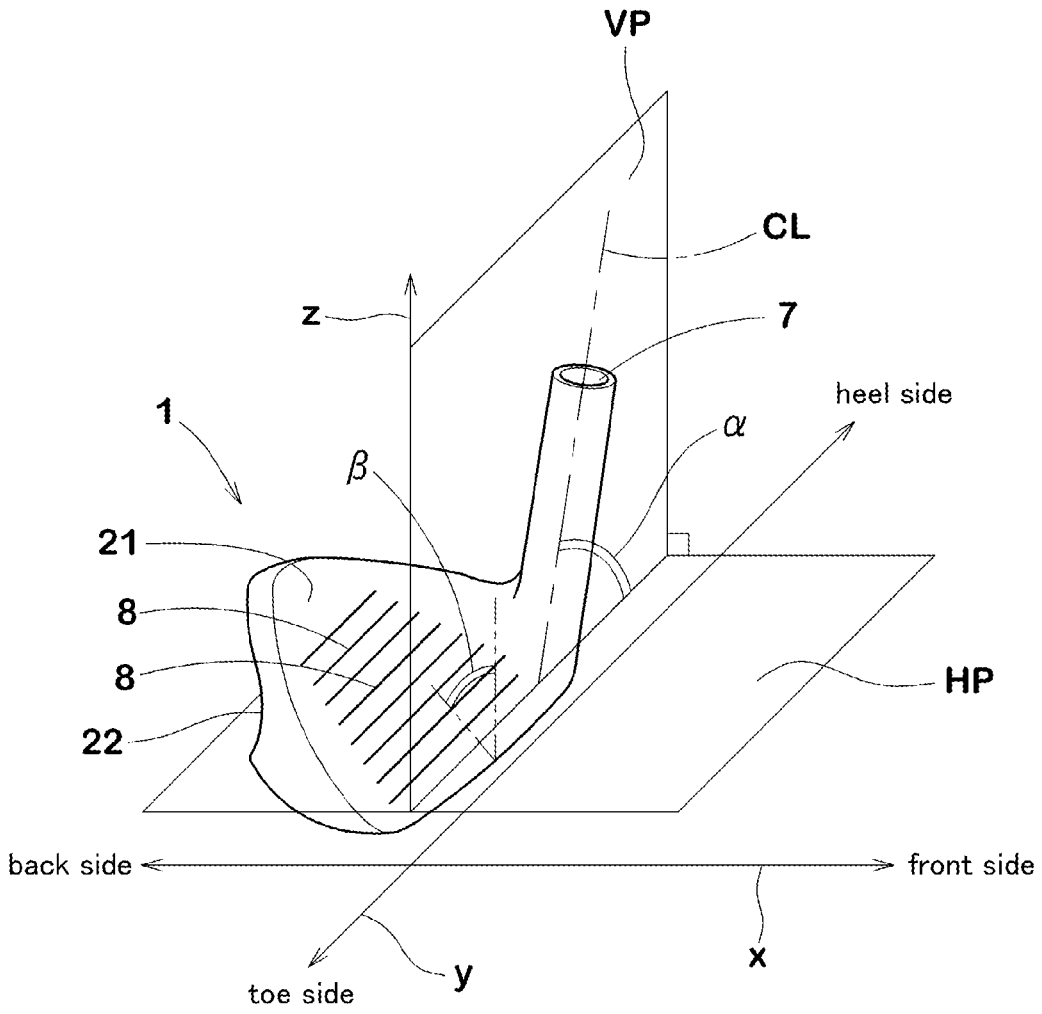
FIG. 5 is a perspective view for explaining the reference state of the golf club head.

In FIGS. 1 to 4, the head 1 is in a reference state. As used herein, the "reference state" of the head 1 means a state in which the head 1 is placed on the horizontal plane HP such that the face lines 8 formed on the striking face 21 are parallel to the horizontal plane HP, as shown conceptually in FIG. 5. In the reference state, the center axis CL of the hosel 7 of the head 1 (the axis of the club shaft) is located within the reference vertical plane VP. The reference vertical plane VP is a plane perpendicular to the horizontal plane HP. In the reference state, the face lines 8 are parallel to both the horizontal plane HP and the reference vertical plane VP. In FIG. 5, $\alpha$ and $\beta$ denote lie angle and loft angle, respectively. In this specification and in the claims, unless otherwise noted, all club head dimensions described herein are taken with the head 1 in the reference state.

[Club Head Direction]

Referring to FIG. 5, the front side of the head 1 means the side of the striking face 21. The back or back side of the head 1 means the side of the back face 22. The front-back direction of the head is the direction of the x-axis orthogonal to the reference vertical plane VP in FIG. 5. The toe-heel direction of the head 1 is the direction of the horizontal y-axis orthogonal to the front-back direction of the head. The vertical direction of the head 1 is the direction of the z-axis orthogonal to both the x-axis and the y-axis. The "upper" and "lower" of the head 1 are the "upper" and "lower" in the reference state, respectively.

[Structure of Each Portion of Head]

Figure 2:
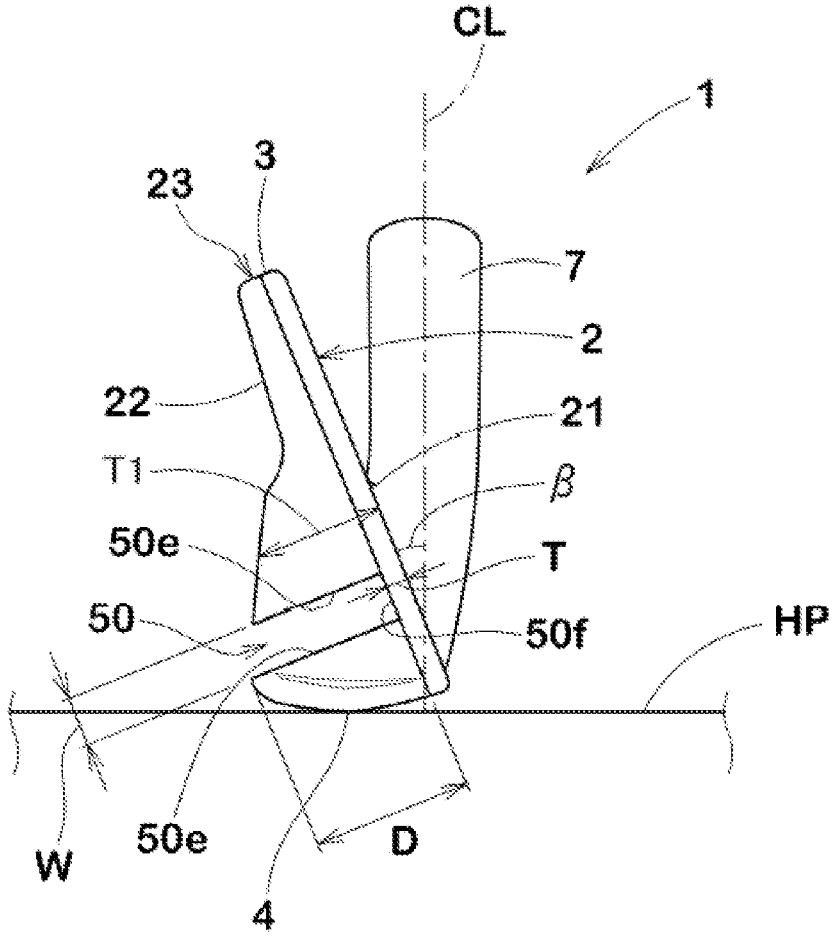
FIG. 2 is a side view of the golf club head according to the first embodiment from the toe side.
Figure 3:
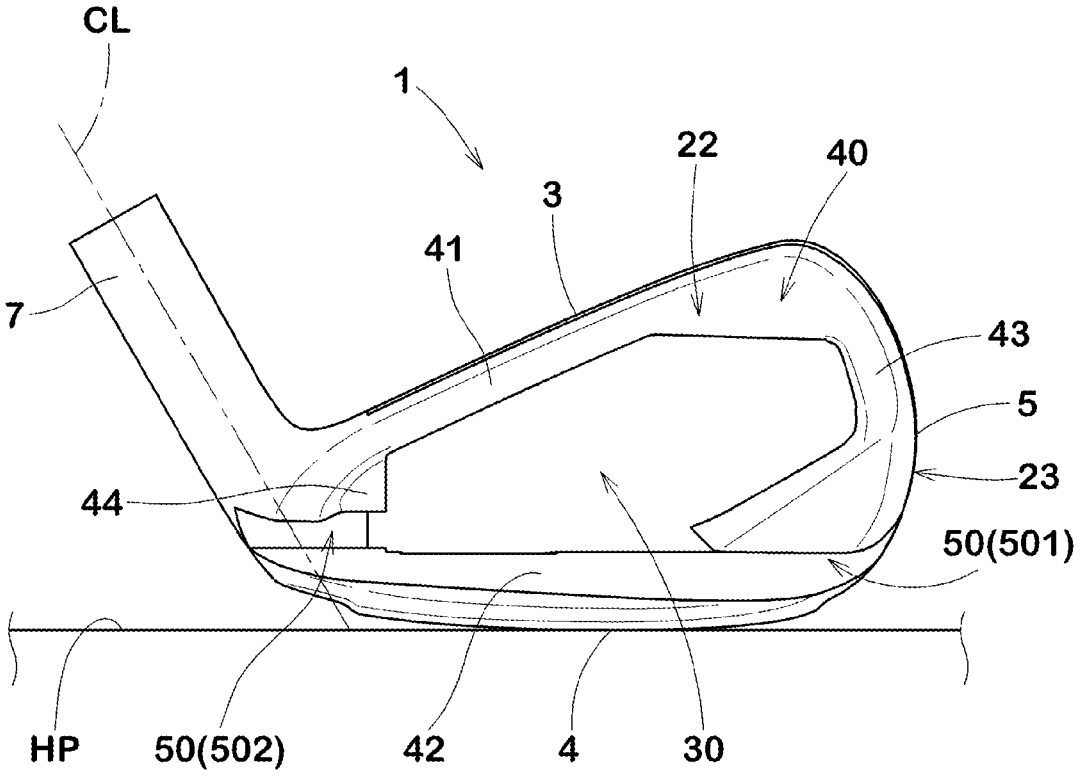
FIG. 3 is a rear view of the golf club head according to the first embodiment.
Figure 4:
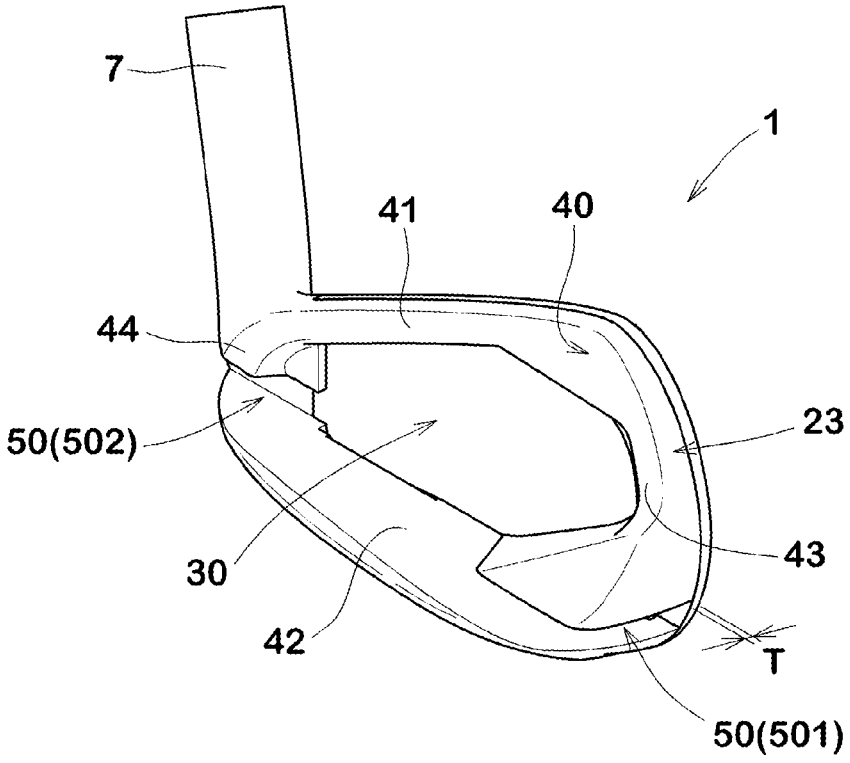
FIG. 4 is a perspective view of the golf club head according to the first embodiment.

As illustrated in FIG. 2 and FIG. 3, the face portion 2 includes the striking face 21 and the back face 22 opposite the striking face 21. In the present embodiment, the striking face 21 is formed by a plane. The face portion 2 further includes a head outer peripheral surface 23 extending between the striking face 21 and the back face 22. As used herein, a face thickness T is the thickness of the continuous solid portion from the striking face 21 to the back face 22. A face thickness T is measured in the direction orthogonal to the striking face 21. FIG. 2 shows face thicknesses T and T1 at two different positions.

The top 3, for example, extends rearward from the upper edge of the striking face 21 to form an upper surface of the head 1.

The sole 4, for example, extends rearward from the lower edge of the striking face 21 to form a bottom surface of the head 1.

As illustrated in FIG. 1, the toe 5 is an end portion of the head 1 in the toe-heel direction farthest from the hosel 7 and smoothly connected between the top 3 and the sole 4.

The heel 6 is an end portion of the head 1 opposite the toe 5 in the toe-heel direction, to which the hosel 7 is connected.

The top 3, the sole 4, the toe 5 and the heel 6 are the components of the head outer peripheral surface 23.

The hosel 7 is provided with a shaft insertion hole 7*a* for receiving a club shaft (not illustrated). The center axis CL of the hosel 7 is defined by the center axis of the shaft insertion hole 7*a*.

As illustrated in FIG. 3, in the present embodiment, the back face 22 of the head 1 includes a cavity 30 recessed on a striking face 21 side and a frame portion 40 extending along the head outer peripheral surface 23 so as to surround the cavity 30. In the cavity 30, a face thickness T is formed to be relatively small. On the other hand, in the frame portion 40, a face thickness T is larger than that of the cavity 30.

The frame portion 40 according to the present embodiment, for example, includes a top-side frame 41, a sole-side frame 42, a toe-side frame 43 and a heel-side frame 44. The top-side frame 41 extends along the top 3 in the toe-heel direction. The sole-side frame 42 extends along the sole 4 in the toe-heel direction. The toe-side frame 43 and the heel-side frame 44 are respectively provided on the toe 5 side and the heel 6 side.

The head 1 having a cavity back structure as described above has a larger moment of inertia around the head center of gravity because more weight is distributed around the face portion 2. Hence, the head 1 according to the present embodiment can suppress the undesired rotational motion of the face portion 2 when the ball is struck at a position outside the sweet spot of the striking face 21. This can help to stabilize the directionality of struck balls.

Although not particularly limited, in order to effectively exert such an effect, a face thickness T at the frame portion 40 is preferably, for example, equal to or more than 5 mm, more preferably equal to or more than 6 mm. Similarly, a face thickness T at the cavity 30, for example, is equal to or less than 3.0 mm, more preferably equal to or less than 2.8 mm. In addition, in order to give the cavity 30 sufficient durability, a face thickness T at the cavity 30, for example, is equal to or more than 1.4 mm, preferably equal to or more than 1.6 mm, still further preferably equal to or more than 1.8 mm.

[Recess(es)]

The frame portion 40 is provided with at least one recess 50. In the present embodiment, the at least one recess 50 extends along the striking face 21 and opens to the head outer peripheral surface 23. As a result, a face thickness Tat the recess 50 is locally reduced.

Such a recess 50 can increase elastically deformation of the face portion 2 when the ball is struck and improve the rebound performance of the head 1. For example, the region with the recess 50 can be greatly deformed at the moment of ball striking, and the subsequent bending back can improve the rebound performance. In addition, the high rebound area of the face portion 2 can be enlarged in the area where the recess 50 is provided, because the elastically deformation of the face portion 2 can be increased. Thus, the head 1 according to the present embodiment can improve the rebound performance without losing the advantage of the cavity back structure. The head 1 according to the present disclosure can provide the above-mentioned effects if at least one recess 50 is provided.

In this embodiment, the recess 50 has a groove shape that includes a pair of groove walls 50*e* (shown in FIG. 2) and opens at the back face 22. Thus, the recess 50 according to the present embodiment can be visually recognized from the back face 22 side. Further, one end of the recess 50 of the present embodiment is also open to the cavity 30. That is, the recess 50 according to the present embodiment continuously extends from the cavity 30 to the head outer peripheral surface 23, dividing the frame portion 40. Therefore, the recess 50 according to the present embodiment can locally reduce the rigidity of the frame portion 40 and flex the face portion 2 more when the ball is struck.

[Position of Recess]

The position of the recess 50 is not particularly limited, and the recess 50 may be provided at various positions. In the embodiments shown in FIG. 3 and FIG. 4, the recess 50, for example, includes a toe-side recess 501 provided on the toe side of the head. As shown in FIG. 2, in a side view of the head 1 from the toe side, the toe-side recess 501 is open at the head outer peripheral surface 23 on the toe side.

In general, iron-type golf club heads tend to have a large face thickness T at the toe-side frame 43. Thus, by providing the toe-side recess 501, elastically deformation of the face portion 2 when striking a ball can be increased and the rebound performance can be improved more effectively.

From a similar point of view, the recess 50 may include a heel-side recess 502 provided on the heel side, as shown in FIG. 3. The heel-side recess 502, for example, is provided on the heel-side frame 44. In a side view of the head 1 from the heel side, the heel-side recess 502 is open at the head outer peripheral surface 23 on the heel side. The heel-side recess 502 may be provided in place of or with the toe-side recess 501.

Figure 6:
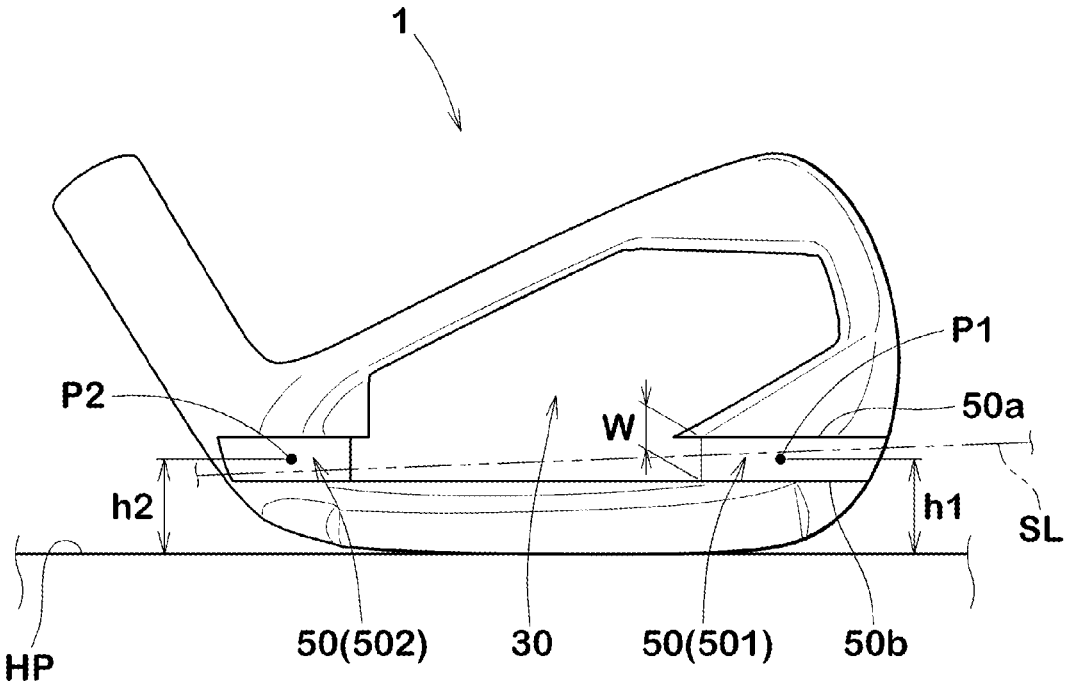
FIG. 6 is a rear view of the golf club head according to the first embodiment with the striking face in a vertical position.

FIG. 6 is a rear view of the striking face 21 in a vertical position. This state is obtained by rotating the head 1 in the reference state about the horizontal axis parallel to the toe-heel direction by the loft angle β. When the at least one recess 50 includes the toe-side recess 501 and the heel-side recess 502, the toe-side recess 501 and the heel-side recess 502 are preferably formed so as to overlap at least partly in the vertical direction of the head in a rear view of the head 1 viewed from the direction orthogonal to the striking face 21. In such an embodiment, the toe-side recess 501, the cavity 30 and the heel-side recess 502 are continuous along the toe-heel direction. Thus, when the ball is struck, the face portion 2 is more likely to deformed elastically along the horizontal axis of the toe-heel direction over a wider range in the toe-heel direction, and as a result, the rebound performance can further be improved. In one aspect of such an embodiment, the toe-side recess 501 and the heel-side recess 502 are arranged such that a virtual straight-line SL can be drawn that completely passes through and within both the toe-side recess 501 and the heel-side recess 502 in the rear view of the head 1 shown in FIG. 6. In this case, an angle of the virtual straight-line SL with respect to the horizontal plane HP is preferably 0 degrees plus/minus 15 degrees, more preferably 0 degrees plus/minus 10 degrees, still further preferably 0 degrees plus/minus 5 degrees. In such an aspect, the effect of promoting the bending deformation of the striking face 21 along the virtual straight-line SL can be expected.

In some more preferred embodiments, the toe-side recess 501 and the heel-side recess 502 are provided at the same height in a rear view of the head 1 such as FIG. 6. In such an aspect, when the ball is struck, the face portion 2 is more likely to bend along the horizontal axis of the toe-heel direction over a wide range in the toe-heel direction, and as a result, the rebound performance can further be improved. As used herein, the "same height", in the rear view of FIG. 6, is intended to include an aspect in which the difference between heights h1 and h2 of the vertical center positions P1 and P2 of the toe-side recess 501 and the heel-side recess 502, respectively, from the horizontal plane HP is within 5 mm, more preferably within 3 mm, still further preferably zero. As used herein, the vertical center positions P1 and P2 of the toe-side recess 501 and the heel-side recess 502, respectively, shall be midway between the uppermost 50*a* and the lowermost 50*b* of the recess 50 appearing in the back face 22 of FIG. 6.

In some preferred aspects, heights h1 and h2 of the recesses 50 may be match or approximate a vertical position of the typical hitting point of golfers who are the target users of the head 1. As a result, when the ball is struck, a bendable portion of the face portion 2 can be positioned at the hitting point of the golfers, and the face portion 2 can be flexed more effectively. This can improve the rebound performance of the head during actual impacts.

In general, iron-type golf club heads have different striking points depending on the loft angle due to the influence of the loft angle. For example, many striking points of an average golfers are at a height of about 12.5 mm from the horizontal HP when the head has a loft angle of about 27 degrees plus/minus 3 degrees. When the head has a loft angle of about 34 degrees plus/minus 4 degrees, many striking points are located at a height of about 11.5 mm from the horizontal HP. When the head has a loft angle of more than 38 degrees, many striking points are located at a height of about 10.5 mm from the horizontal HP. Thus, it is preferable that the heights h1 and h2 of the recesses 50 be set so as to match the hitting points of the golfers described above according to the loft angle of the head 1. Such a group of the heads 1 can provide a golf club set in which the vertical center position of the recess 50 gradually decreases as the loft angle increases.

[Size of Recess(es)]

The size of the recesses 50 is not particularly limited and can be set in various ways. However, in order to exert the effects of the recesses 50 more effectively, it may be preferable that a width W and a depth D of the recesses 50 are specified.

As illustrated in FIG. 2 and FIG. 6, in a rear view of the head 1 viewed from the direction orthogonal to the striking face 21, a width W of the recesses 50 is measured as the shortest distance between the pair of groove walls 50*e* and 50*e* (shown in FIG. 2) of each recess 50. If a width W of the recesses 50 changes, the width is specified as the maximum width. A width W of the recesses 50, for example, is equal to or more than 1.0 mm, more preferably equal to or more than 2.0 mm, still further preferably equal to or more than 3.0 mm. On the other hand, when a width W of the recesses 50 becomes excessively large, the weight there tends to be small, and thus the advantage of the cavity back tends to be impaired. From this point of view, a width W of the recesses 50, for example, is preferably equal to or less than 10.0 mm, more preferably equal to or less than 9.0 mm, still further preferably equal to or less than 8.0 mm.

As illustrated in FIG. 2, a depth D of the recesses is measured perpendicular to the striking face 21. A depth D of the recesses 50 determines the face thickness T of the portion where the recesses 50 are provided. In some preferred aspects, by adjusting a depth D of the recesses 50, a face thickness T of the portion where the recesses 50 are provided, for example, is equal to or less than 3.2 mm, preferably equal to or less than 3.0 mm, still further preferably equal to or less than 2.8 mm. On the other hand, when a depth D of the recess 50 becomes excessively large, the weight there tends to be small and the advantages of the cavity back tend to be impaired. From this point of view, a face thickness T of the portion where the recesses 50 are provided, for example, is preferably equal to or more than 1.7 mm, preferably equal to or more than 1.8 mm, still further preferably equal to or more than 1.9 mm.

[Head Structure]

The head 1 can be manufactured by various methods. In one embodiment, the head 1 can be manufactured as a one-piece structure by various methods such as casting, forging, sintering and the like.

Figure 7:
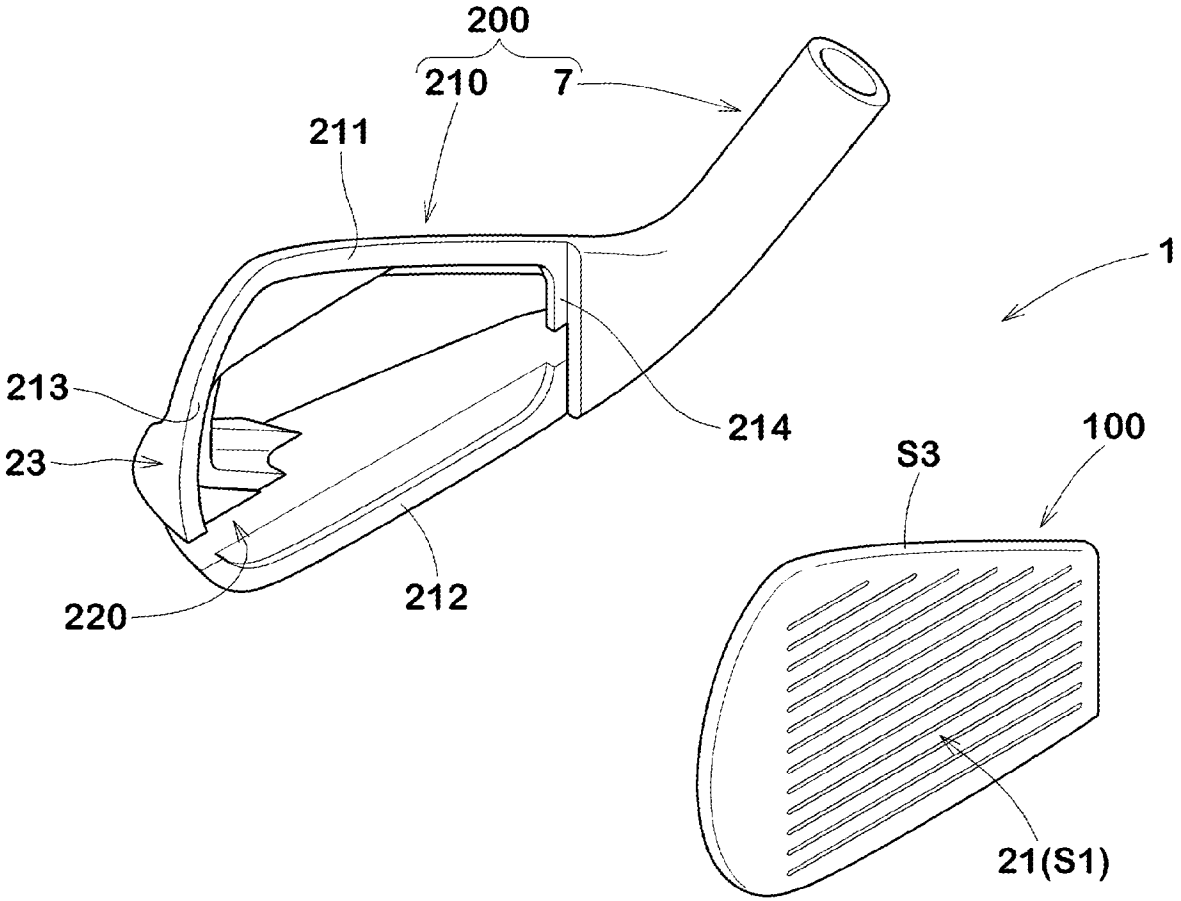
FIG. 7 is an exploded perspective view of the golf club head according to the first embodiment as viewed from the front side.
Figure 8:
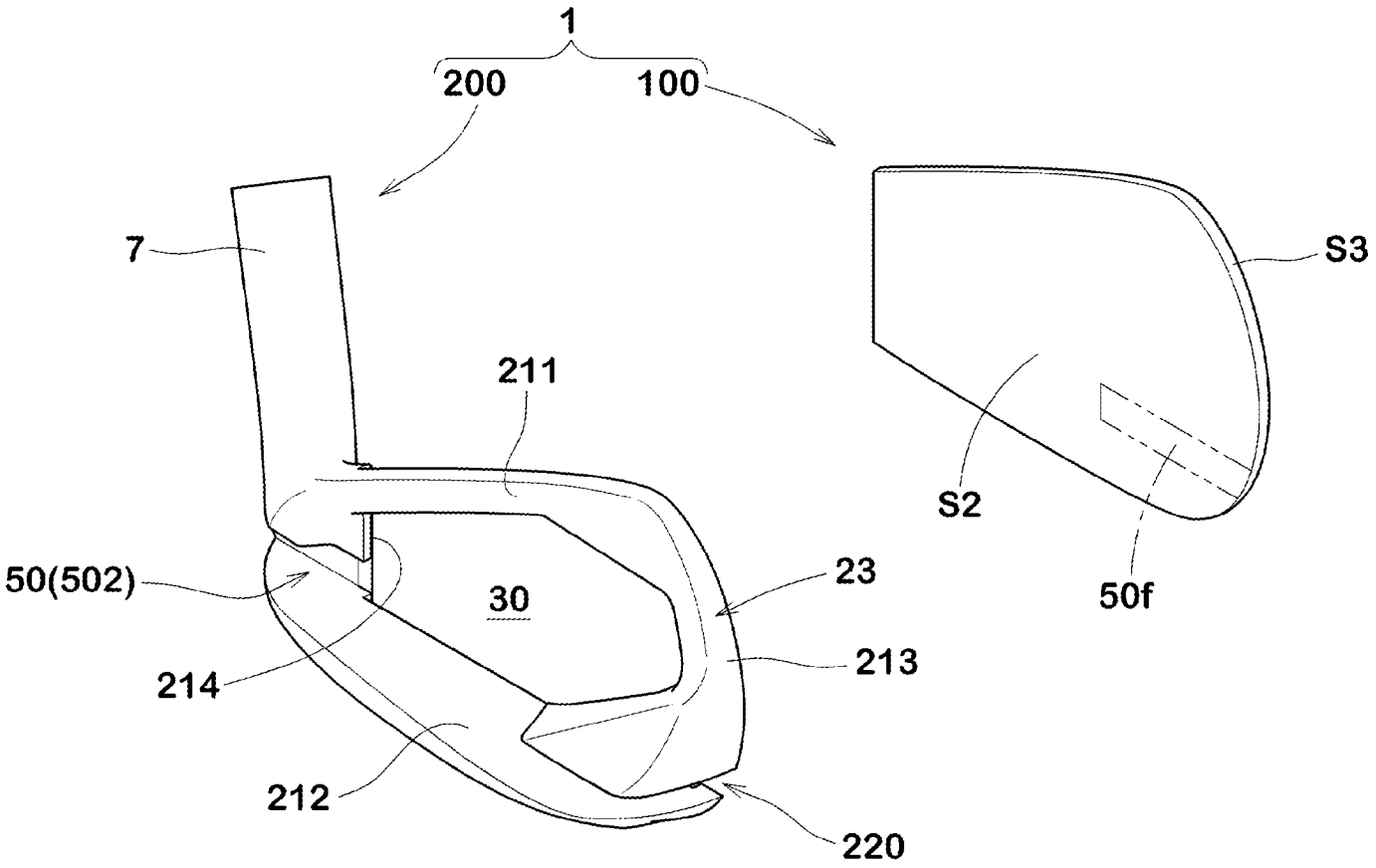
FIG. 8 is an exploded perspective view of the golf club head according to the first embodiment as viewed from the back side.

In another aspect, the head 1 may be a multi-piece structure including two or more members joined together. FIG. 7 and FIG. 8 show exploded perspective views of such a head 1. As illustrated in FIG. 7 and FIG. 8, the head 1, for example, includes a face plate 100 and a head main body 200 supporting the face plate 100 from behind the head.

The face plate 100, for example, is formed as a plate made of metal material. The face plate 100 according to the present embodiment includes a first surface S1 forming the striking face 21 at least partially, a second surface S2 opposite the first surface S2, and a third surface S3 connecting the first surface S1 and the second surface S2. The third surface S3 forms a peripheral surface of the face plate 100.

The head main body 200, for example, includes the hosel 7 and a support portion 210.

The support portion 210 extends along the head outer peripheral surface 23 so as to surround the cavity 30 (shown in FIG. 2). Further, the support portion 210 supports the second surface S2 of the face plate 100 from behind. Thereby, the support portion 210 is joined with the second surface S2 of the face plate 100 to form the frame portion 40.

In the present embodiment, the support portion 210 includes a top-side support portion 211, a sole-side support portion 212, a toe-side support portion 213 and a heel-side support portion 214 which support a top side, a sole side, a toe side and a heel side of the face plate 100, respectively.

The top-side support portion 211, the sole-side support portion 212 and the toe-side support portion 213 respectively support only the second surface S2 of the face plate 100, and do not support the third surface S3 of the face plate 100. On the other hand, the heel-side support portion 214 supports the second surface S2 and the third surface S3 of the face plate 100. As a result, the head main body 200 according to the present embodiment exposes a top side surface, a toe side surface and a sole side surface of the third surface S3 of the face plate 100 to the head outer peripheral surface 23. In other words, the top side, toe side and sole side of the third surface S3 of the face plate 100 form a front side part of the head outer peripheral surface 23.

The head main body 200 according to the present embodiment further includes at least one discontinuous portion 220. The discontinuous portion 220 is a region of the support portion 210 that interrupts continuity along the head outer peripheral portion 23. In this embodiment, the discontinuous portion 220 is a space formed between the toe-side support portion 213 and the sole-side support portion 212. Such a discontinuous portion 220 forms the toe-side recess 501 where the second surface S2 is exposed to the rear of the head up to the third surface S3. The toe-side recess 501 has a groove shape extending along the striking face 21, and the groove shape has one end opening to the cavity 30 and the other end opening to the head outer peripheral surface 23. Further, a bottom surface 50f of the toe-side recess 501 (shown by a virtual line in FIG. 8) is formed by a part of the second surface S2 of the face plate 100.

In the embodiment shown in FIG. 7 and FIG. 8, the heel-side recess 502 is a groove shaped depression formed between the heel-side support portion 214 and the sole-side support portion 212. In another aspect, the heel-side recess 502 may also be formed as the discontinuous portion 220. In this case, the head main body 200 has the support portion 212 on the sole side as an independent member.

As described above, when the head 1 is formed by joining two or more members, the face plate 100 may be made of a metal material having a lower density and/or lower elasticity than those of the head main body 200. Such a head can provide even greater moment of inertia and/or repulsion performance.

[Variation of Location of Recess(es)]

Figure 9:
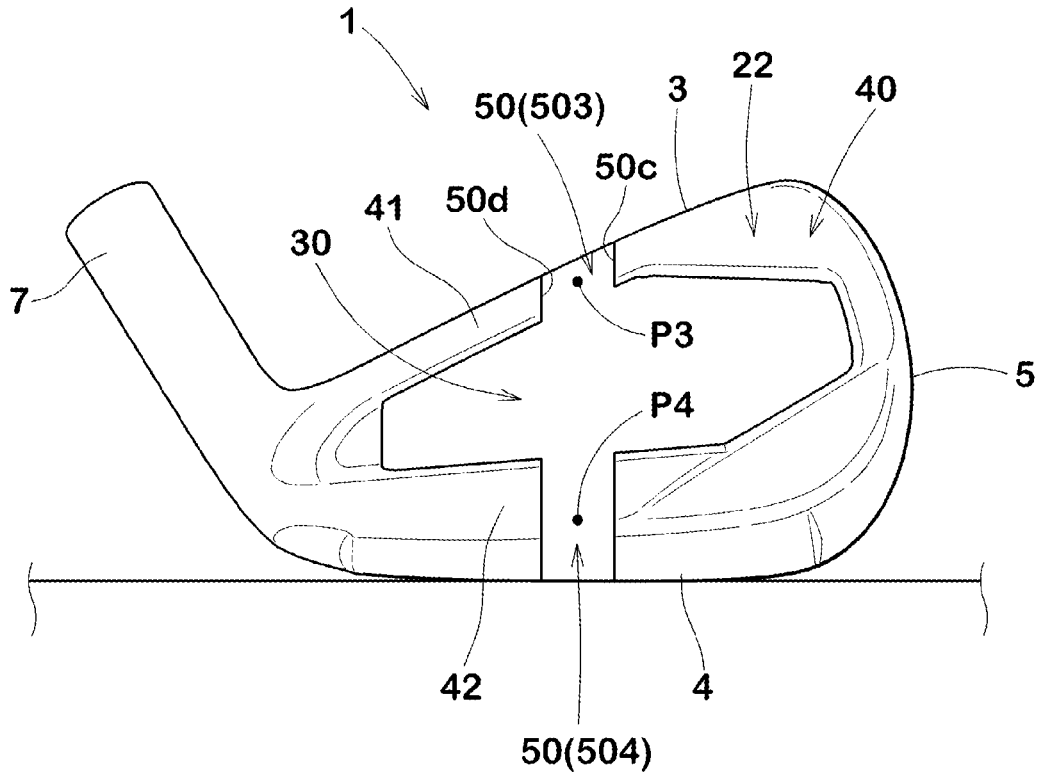
FIG. 9 is a rear view of the golf club head showing a modified example of the recesses.
Figure 10:
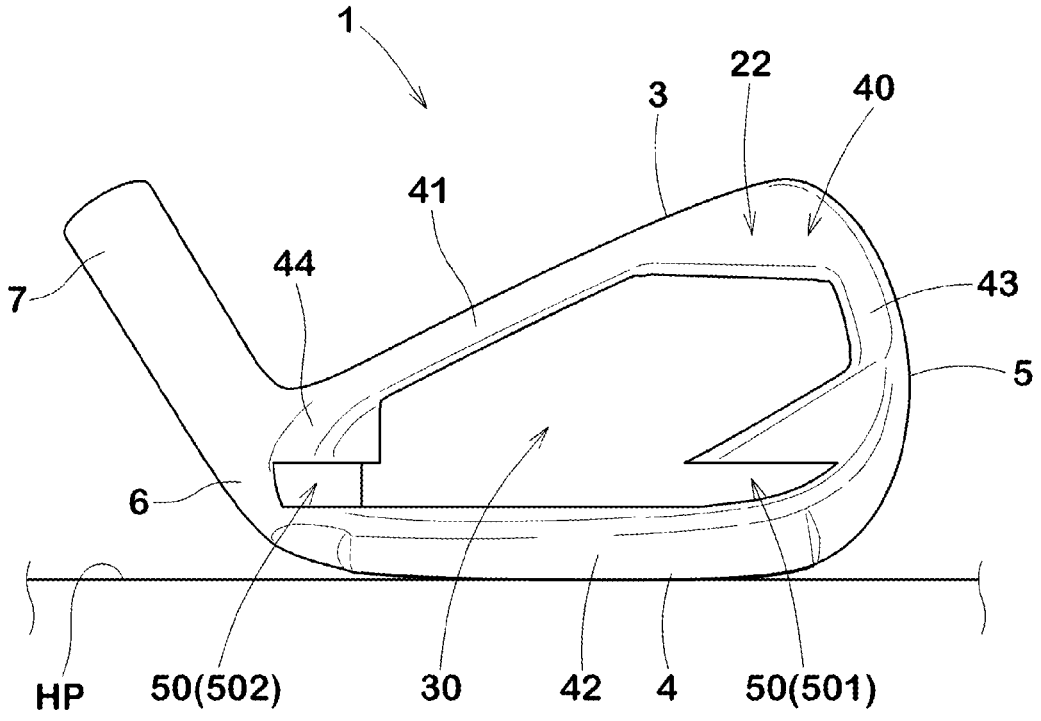
FIG. 10 is a rear view of the golf club head according to the second embodiment with the striking face in a vertical position.
Figure 11:
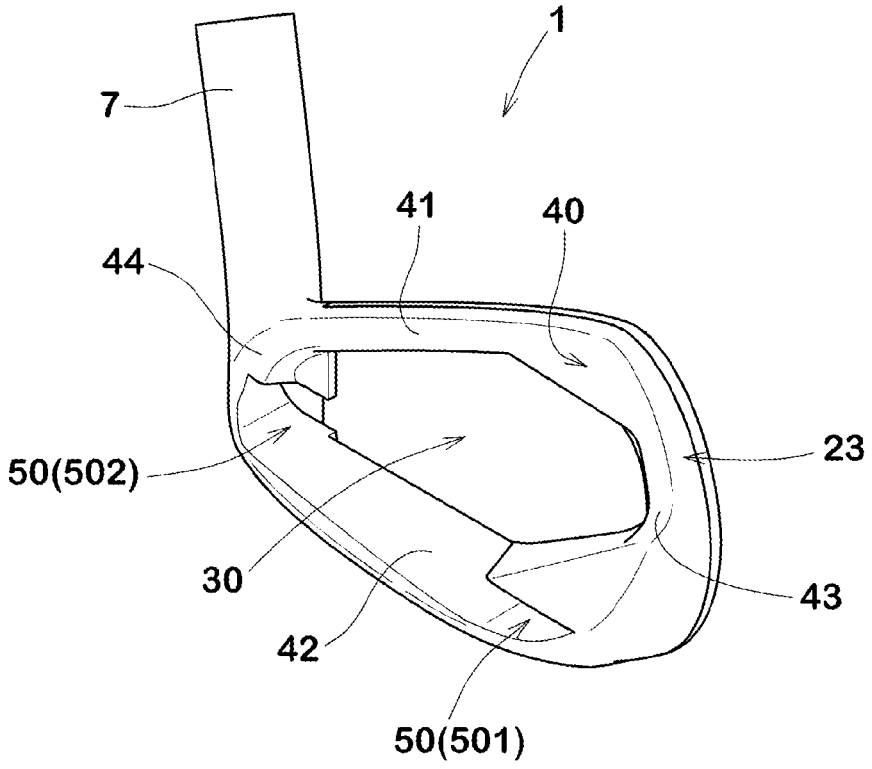
FIG. 11 is a perspective view of the golf club head according to the second embodiment.

FIG. 9 is a rear view of the head 1 with the striking face 21 vertical. As illustrated in FIG. 9, the recess 50 may be a top-side recess 503 provided on the top 3 side and/or a sole-side recess 504 provided on the sole 4 side. The top-side recess 503, for example, is provided on the top-side frame 41. The sole-side recess 503, for example, is provided on the sole-side frame 42. In such an aspect of the head, elastic deformation is promoted such that the face portion 2 bends along the vertical axis when the ball is struck, and the subsequent return of bending can improve the rebound performance.

In some preferred embodiments, the top-side recess 503 and the sole-side recess 504 overlap with each other at least partially in the toe-heel direction. In such an embodiment, the top-side recess 503, the cavity 30 and the sole-side recess 504 are continuous in the vertical direction. For this reason, when a ball is struck, the face portion 2 is more likely to bend along the vertical axis along the striking face 21 over a wider range in the vertical direction, and thus the rebound performance of the head 1 can be improved further.

In some particularly preferred embodiments, the top-side recess 503 and the sole-side recess 504 are provided at the same position in the toe-heel direction in the rear view of the head. As used herein, the "same position", in a rear view of the head, is intended to include an aspect in which a distance in the toe-heel direction between the center positions P3 and P4 in the toe-heel direction of the top-side recess 503 and the sole-side recess 504, respectively, is within 5 mm, more preferably within 3 mm, still further preferably zero. Furthermore, as used herein, the center positions P3 and P4 in the toe-heel direction of the top-side recess 503 and the sole-side recess 504, respectively, shall be midway between the most toe-side position 50c and the most heel-side position 50d of the respective recesses 503 and 504 appearing in the back face 22 in FIG. 9.

In the above embodiment, the recesses 50 are left as it is. In other aspects, the recesses may be filled with an elastic material such as rubber, elastomer, etc. that does not interfere with the elastic deformation of the face portion 2.

The Second Embodiment

Figure 12:
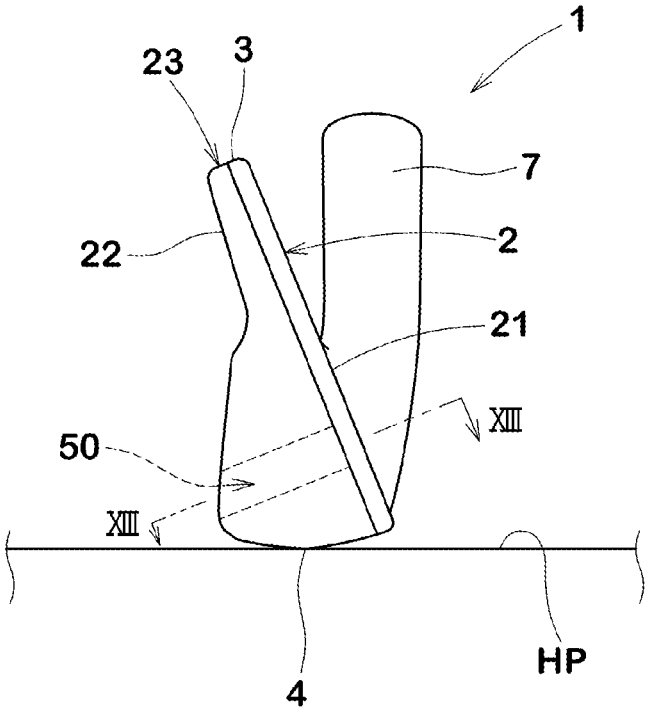
FIG. 12 is a side view of the golf club head according to the second embodiment from the toe side.
Figure 13:
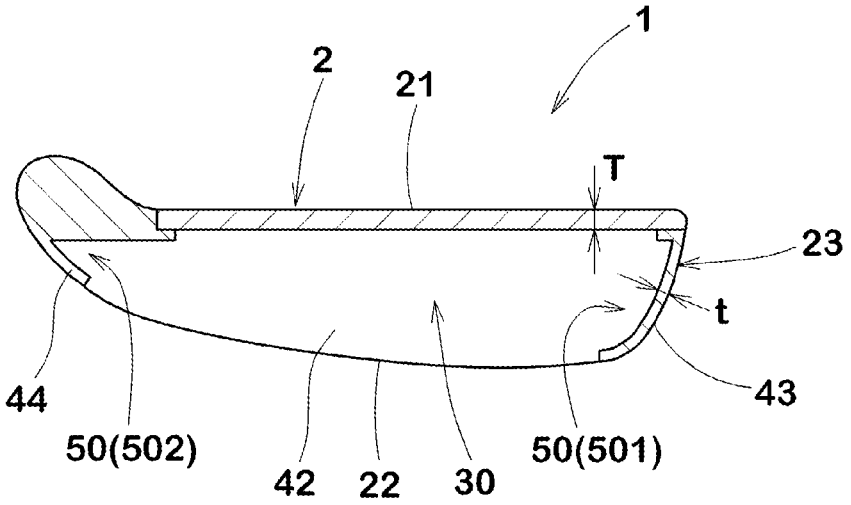
FIG. 13 is a cross-sectional view taken along the lines XIII-XIII of FIG. 12.

FIGS. 10, 11, 12 and 13 illustrate a rear view, a perspective view, a side view from toe side, and a cross-sectional view taken along the line XIII-XIII of FIG. 12, respectively, of the head 1 according to the second embodiment. The head 1 according to the second embodiment differs from the first embodiment only in the shape of the recesses 50, and the other structures are the same.

As illustrated in FIG. 10 to FIG. 13, in the head 1 according to the second embodiment, the recesses 50 extend along the striking face 21, but does not open in the head outer peripheral surface 23. A thickness t between each of the recesses 50 and the head outer peripheral surface 23 is equal to or less than 2 mm, preferably equal to or less than 1.5 mm, still further preferably equal to or less than 1.0 mm.

The recesses 50 according to the second embodiment do not open to the head outer peripheral surface 23, but extends to the vicinity of the head outer peripheral surface 23. Thus, the recesses 50 according to the second embodiment also increase the elastically deformation of the face portion 2 when the ball is struck, and can improve the rebound performance.

While the particularly preferable embodiments in accordance with the present disclosure have been described in detail, the present disclosure is not limited to the illustrated embodiments, but can be modified and carried out in various aspects within the scope of the disclosure.

EXAMPLE

Hereinafter, more specific and non-limiting examples of the present disclosure will be described. Two-piece iron-type golf club heads having the basic structure described in FIGS. 1 to 4 and 7 to 9 were designed according to the specifications shown in Table 1. Then, their rebound performance, launch angle of struck ball and moment of inertia were tested by computer simulation.

The basic specifications of the heads are as follows.

Loft angle: 22 degrees

Head weight: 246 (g)

Material of the face plate: Spring steel

Material of the head main body: S20C

Face thickness at the cavity: 2.7 mm (with common wall thickness distribution)

The test method is as follows.

[Rebound Performance]

As the rebound performance, COR was calculated by computer simulation. The calculation of COR means Coefficient of Restitution, and is defined by the USGA (United States Golf Association), "Interim Procedure for Measuring the Coefficient of Restitution of an Iron Clubhead Relative to a Baseline Plate Revision 1.3 Jan. 1, 2006". The result is an index with the COR value of the comparative example as 100. It can be evaluated that the larger the value, the better the rebound performance of the face at the measurement position. The COR value was calculated at the location of the sweet spot.

[Launch Angle of Struck Ball]

A hitting simulation was performed on each golf club head model, and the launch angle of the struck ball with respect to the horizontal plane was calculated. Table 1 shows the index with the value of the comparative example as 100. The larger the value, the larger the launch angle and the better.

[Moment of Inertia]

In order to evaluate only the effect of the recesses formed in the frame portion as much as possible, the simulation was performed under the condition that the head weight and the moment of inertia are aligned by arranging the virtual weight that does not affect the deformation of the head in the recesses in a non-contact manner. The moment of inertia is the moment of inertia around the horizontal axis of the toe-heel direction passing through the center of gravity of the head. The values in Table 1 show the exponent with the moment of inertia of the comparative example as 100, and they are all the same.

The test results are shown in Table 1.

TABLE 1

| | Comparative example | Ex. 1 | Ex. 2 | Ex. 3 | Ex. 5 | Ex. 6 | Ex. 7 |
|---|---|---|---|---|---|---|---|
| Figure showing aspect of recess(es) | FIG. 6 | FIG. 6 | FIG. 6 | FIG. 6 | FIG. 6 | FIG. 6 | FIG. 9 |
| Presence or absence of toe-side recess | Absence | presence | presence | presence | presence | absence | absence |
| Presence or absence of heel-side recess | Absence | presence | presence | presence | absence | presence | absence |
| Presence or absence of top-side recess | Absence | absence | absence | absence | absence | absence | presence |
| Presence or absence of sole-side recess | Absence | absence | absence | absence | absence | absence | presence |
| Recess width W (mm) | 0 | 6 | 6 | 6 | 6 | 6 | 6 |
| Recess depth D (mm) | 0 | 19.8 | 18.8 | 19.8 | 19.8 | 19.8 | 17.3 |
| Face thickness T at recess(es) (mm) | 0 | 2.7 | 2.7 | 2.7 | 2.7 | 2.7 | 2.7 |
| Height h1 (mm) | — | 16 | 16 | 21 | 16 | — | — |
| Height h2 (mm) | — | 16 | 16 | 16 | — | 16 | — |
| Difference \|h1 − h2\| (mm) | — | 0 | 0 | 5 | — | — | — |
| Rebound performance (index) | 100 | 106 | 105 | 104 | 101 | 103 | 102 |
| Launch angle of struck ball (index) | 100 | 105 | 104 | 103 | 101 | 102 | 100 |
| Moment of inertia (index) | 100 | 100 | 100 | 100 | 100 | 100 | 100 |

As a result of the test, it was confirmed that the golf club heads of the examples had higher rebound performance and higher launch angle than the comparative example.

[Additional Note]

The present disclosure includes the following aspects.

[Note 1]

A golf club head comprising:

a face portion comprising a striking face for hitting a ball, a back face opposite the striking face, and a head outer peripheral surface extending between the striking face and the back face, wherein the back face comprising a cavity recessed on a striking face side and a frame portion extending along the head outer peripheral surface so as to surround the cavity, and the frame portion is provided with at least one recess that extends along the striking face and opens to the head outer peripheral surface.

[Note 2]

The golf club head according to note 1, wherein the at least one recess has a groove shape that opens at the back face.

[Note 3]

The golf club head according to note 1 or 2, wherein the at least one recess comprises a toe-side recess provided on a toe side of the frame portion.

[Note 4]

The golf club head according to any one of notes 1 to 3, wherein the at least one recess comprises a heel-side recess provided on a heel side of the frame portion.

[Note 5]

The golf club head according to any one of notes 1 to 3, wherein the at least one recess comprises a toe-side recess provided on a toe side of the frame portion and a heel-side recess provided on a heel side of the frame portion, and in a rear view of the golf club head orthogonal to the striking face, the toe-side recess and the heel-side recess overlap with each other in a vertical direction of the golf club head.

[Note 6]

The golf club head according to any one of notes 1 to 5, wherein the at least one recess opens to the cavity.

[Note 7]

The golf club head according to any one of notes 1 to 6, comprising:

a face plate, and a head main body supporting the face plate, wherein the face plate comprises a first surface forming the striking face at least partially, a second surface opposite the first surface, and a third surface connecting the first surface and the second surface, the head main body comprises a support portion extending along the head outer peripheral surface so as to surround the cavity, the support portion supports the second surface of the face plate, the head main body comprises a discontinuous portion of the support portion that interrupts continuity along the head outer peripheral portion, and the second surface is exposed to a back face side through the discontinuous portion to form the at least one recess.

[Note 8]

A golf club head comprising:

a face portion comprising a striking face for hitting a ball, a back face opposite the striking face, and a head outer peripheral surface extending between the striking face and the back face, wherein the back face is provided with a cavity recessed on a striking face side and a frame portion extending along the head outer peripheral surface so as to surround the cavity, the frame portion is provided with at least one recess that extends along the striking face and terminates so as not to open to the head outer peripheral surface, and a thickness between the at least one recess and the head outer peripheral surface is equal to or less than 2 mm.

[Note 9]

The golf club head according to note 8, wherein the at least one recess comprises at least one groove that opens to the back face.

[Note 10]

The golf club head according to note 8 or 9, wherein the at least one recess comprises a toe-side recess provided on a toe side of the frame portion.

[Note 11]

The golf club head according to any one of notes 8 to 10, wherein the at least one recess comprises a heel-side recess provided on a heel side of the frame portion.

[Note 12]

The golf club head according to any one of notes 8 to 11, wherein the at least one recess opens to the cavity.

[Note 13]

The golf club head according to any one of notes 8 to 12, wherein the at least one recess comprises a toe-side recess provided on a toe side of the frame portion and a heel-side recess provided on a heel side of the frame portion, and in a rear view of the golf club head orthogonal to the striking face, the toe-side recess and the heel-side recess overlap with each other in a vertical direction of the golf club head.

[Note 14]

The golf club head according to any one of notes 1 to 13, wherein a width W of the at least one recess is in a range from 3.0 to 10.0 mm.

[Note 15]

The golf club head according to any one of notes 1 to 14, wherein a face thickness T at the at least one recess is in a range from 1.7 to 3.2 mm.

The invention claimed is:

1. A golf club head comprising:

a face portion comprising a striking face for hitting a ball, a back face opposite the striking face, and a head outer peripheral surface extending between the striking face and the back face, wherein the back face comprising a cavity recessed on a striking face side and a frame portion extending along the head outer peripheral surface so as to surround the cavity, and the frame portion is provided with at least one recess that extends along the striking face and opens to the head outer peripheral surface, wherein the at least one recess comprises a toe-side recess provided on a toe side of the frame portion and a heel-side recess provided on a heel side of the frame portion, and in a rear view of the golf club head orthogonal to the striking face, the toe-side recess and the heel-side recess overlap with each other in a vertical direction of the golf club head.

2. The golf club head according to claim 1, wherein the at least one recess has a groove shape that opens at the back face.

3. The golf club head according to claim 1, wherein the at least one recess opens to the cavity.

4. The golf club head according to claim 1, comprising:

a face plate, and a head main body supporting the face plate, wherein the face plate comprises a first surface forming the striking face at least partially, a second surface opposite the first surface, and a third surface connecting the first surface and the second surface, the head main body comprises a support portion extending along the head outer peripheral surface so as to surround the cavity, the support portion supports the second surface of the face plate, the head main body comprises a discontinuous portion of the support portion that interrupts continuity along the head outer peripheral portion, and the second surface is exposed to a back face side through the discontinuous portion to form the at least one recess.

5. The golf club head according to claim 1, wherein a width W of the at least one recess is in a range from 3.0 to 10.0 mm.

6. The golf club head according to claim 5, wherein a face thickness T at the at least one recess is in a range from 1.7 to 3.2 mm.

7. A golf club head comprising:

a face portion comprising a striking face for hitting a ball, a back face opposite the striking face, and a head outer peripheral surface extending between the striking face and the back face, wherein the back face is provided with a cavity recessed on a striking face side and a frame portion extending along the head outer peripheral surface so as to surround the cavity, the frame portion is provided with at least one recess that extends along the striking face and terminates so as not to open to the head outer peripheral surface, and a thickness between the at least one recess and the head outer peripheral surface is equal to or less than 2 mm, wherein the at least one recess opens to the cavity.

8. The golf club head according to claim 7, wherein the at least one recess comprises at least one groove that opens to the back face.

9. The golf club head according to claim 7, wherein the at least one recess comprises a toe-side recess provided on a toe side of the frame portion.

10. The golf club head according to claim 7, wherein the at least one recess comprises a heel-side recess provided on a heel side of the frame portion.

11. The golf club head according to claim 7, wherein the at least one recess comprises a toe-side recess provided on a toe side of the frame portion and a heel-side recess provided on a heel side of the frame portion, and in a rear view of the golf club head orthogonal to the striking face, the toe-side recess and the heel-side recess overlap with each other in a vertical direction of the golf club head.

12. The golf club head according to claim 7, wherein a width W of the at least one recess is in a range from 3.0 to 10.0 mm.

13. The golf club head according to claim 12, wherein a face thickness T at the at least one recess is in a range from 1.7 to 3.2 mm.

14. A golf club head comprising:

a face portion comprising a striking face for hitting a ball, a back face opposite the striking face, a head outer peripheral surface extending between the striking face and the back face, a face plate, and a head main body supporting the face plate, wherein the back face comprising a cavity recessed on a striking face side and a frame portion extending along the head outer peripheral surface so as to surround the cavity, and the frame portion is provided with at least one recess that extends along the striking face and opens to the head outer peripheral surface, wherein the face plate comprises a first surface forming the striking face at least partially, a second surface opposite the first surface, and a third surface connecting the first surface and the second surface, the head main body comprises a support portion extending along the head outer peripheral surface so as to surround the cavity, the support portion supports the second surface of the face plate, the head main body comprises a discontinuous portion of the support portion that interrupts continuity along the head outer peripheral portion, and the second surface is exposed to a back face side through the discontinuous portion to form the at least one recess.

15. A golf club head comprising:

a face portion comprising a striking face for hitting a ball, a back face opposite the striking face, and a head outer peripheral surface extending between the striking face and the back face, wherein the back face is provided with a cavity recessed on a striking face side and a frame portion extending along the head outer peripheral surface so as to surround the cavity, the frame portion is provided with at least one recess that extends along the striking face and terminates so as not to open to the head outer peripheral surface, and a thickness between the at least one recess and the head outer peripheral surface is equal to or less than 2 mm, wherein the at least one recess comprises a toe-side recess provided on a toe side of the frame portion and a heel-side recess provided on a heel side of the frame portion, and in a rear view of the golf club head orthogonal to the striking face, the toe-side recess and the heel-side recess overlap with each other in a vertical direction of the golf club head.

* * * * *